United States Patent [19]

Rowe

[11] 4,275,779

[45] Jun. 30, 1981

[54] LOG-SPLITTING APPARATUS

[76] Inventor: William D. Rowe, 1825 Vermont Ave., Connersville, Ind. 47331

[21] Appl. No.: 140,729

[22] Filed: Apr. 16, 1980

[51] Int. Cl.[3] ..... B27L 7/00

[52] U.S. Cl. ..... 144/193 A; 144/193 K; 248/349

[58] Field of Search ..... 248/349; 144/3 K, 193 R, 144/193 A, 193 E, 193 K

[56] References Cited

U.S. PATENT DOCUMENTS

| | | | |
|---|---|---|---|
| 49,913 | 9/1865 | Penny | 144/193 K |
| 205,550 | 7/1878 | Hildreth | 144/193 K |
| 881,538 | 3/1908 | Bienk | 144/193 |
| 1,425,298 | 8/1922 | Treat | 144/193 |
| 2,653,827 | 9/1953 | Manning | 248/349 |
| 2,687,267 | 8/1954 | Copenhaver | 248/349 |
| 3,799,295 | 12/1973 | Balsbaugh | 144/193 A |
| 4,086,111 | 4/1978 | Corey | 144/193 A |
| 4,102,373 | 7/1978 | Winiasz | 144/193 A |

*Primary Examiner*—W. D. Bray

*Attorney, Agent, or Firm*—Woodard, Weikart, Emhardt & Naughton

[57] ABSTRACT

An adjustable log-splitting apparatus of the type wherein a wedge-shaped cutter is slidably received on a vertical column for splitting logs placed therebeneath includes the improvement of a base platform having a top plate member and a supporting frame member wherein the top plate member is able to be raised by a foot treadle and once raised, is able to be manually rotated about a central pivot axis relative to the supporting frame member. Pivotal movement of the top plane member relative to the supporting frame member is achieved by means of a cylindrical post which is both slidably and pivotally received within a closely sized aperture. In a static condition, the top plate member rests on the outer periphery edge of the supporting frame member. However, when the foot treadle is depressed, four rollers are pivoted into a raised orientation thereby drawing these rollers into direct contact with the underside of the top plate member and actually raising the top plate member up off of the supporting frame member. The action which brings these rollers into contact with the underside of the top plate member also orients the axis of rotation of these rollers into the same horizontal plane and each axis line intersects the axis of rotation of the top plate member relative to the supporting frame member.

13 Claims, 6 Drawing Figures

LOG-SPLITTING APPARATUS

BACKGROUND OF THE INVENTION

This application relates in general to log-splitting apparata and in particular to such apparata which are adjustable for enabling the log to be split to be oriented in a variety of positions.

As most of us know, the task of splitting logs varies as to its difficulty, depending upon the size of the log and the type of wood. If one wishes to split relatively small logs, the task can be accomplished by a small ax or hatchet. As the logs become larger, both in diameter size and length, additional tools are often necessary. Such additional tools typically include a wedge which is driven into a cut or crack in the log. As the wedge is driven further and further into the log, the increased thickness of the wedge causes the split in the log to widen. By using additional wedges and continuing to drive these wedges into the log, virtually any log can be split into smaller pieces.

As with many other tasks which constitute a significant expenditure of physical exertion, log splitting has evolved into a more automated procedure whereby man has created machines to do much of the work. Log-splitting devices are not necessarily new, as evidenced by the list of patents which follows. Log-splitting apparata reduced to their most basic form typically incorporate a wedge-shaped cutter disposed on a vertical column and some type of drive means to force this cutter into the end of a log which is located beneath the cutter. The following list of patents discloses log-splitting apparata which relate to the basic concept of driving a cutter into a log.

| Patent No. | Patentee | Issue Date |
|---|---|---|
| 49,913 | Penny | 9/12/1865 |
| 205,550 | Hildreth | 7/02/1878 |
| 269,856 | Holcombe | 1/02/1883 |
| 881,538 | Bienk | 3/10/1908 |
| 1,425,298 | Treat | 8/08/1922 |
| 3,779,295 | Balsbaugh | 12/18/1973 |
| 4,086,111 | Corey | 4/25/1978 |
| 4,102,373 | Winiasz | 7/25/1978 |

Penny discloses a device for splitting wood wherein a linkage arm is connected between a drive wheel shaft and a cutter. Rotation of the drive wheel causes the cutter to move in a downwardly direction toward a log-supporting platform. Although the log-supporting platform is bolted to the frame, it is adjustable as to vertical height allowing for variation in log sizes.

Hildreth discloses a machine for splitting wood which is very similar to the Penny patent reference. In Hildreth, a pulley and drive belt is utilized for the rotary motion which is coupled to the cutter by a pitman. The pivotal connection at each end of the pitman first to the wheel-driven shaft and secondly to the cutter, enables downward movement in a cyclic, repeating action.

Holcombe discloses a wood-splitting machine, again of the type which incorporates a pitman coupled between a drive wheel and the cutter. The pivotal connections at each end of the pitman, first to the wheel and then to the cutter, enable the cutter to move up and down in a cyclic action as the wheel has a constant direction of rotation.

Bienk discloses a wood cleaver wherein a fulcrum arm or lever is movable in a downwardly direction in order to exert a force on the top end of a hatchet which is slidably received with a supporting frame member. This downward movement of the hatchet forces the hatchet into a log which is placed on a platform therebeneath.

Treat discloses a wood-splitting machine wherein the ax or splitting member is able to be elevated and subsequently released so as to drop by the force of gravity on the wood and thereby split the wood. An arrangement of linkages, wheels, cables and pulleys are incorporated in order to do the raising of the cutter to a significant height elevation above the block of wood positioned therebeneath.

Balsbaugh discloses a portable log-splitting and tube-bending apparatus which includes a vertically disposed frame preferably adapted to be mounted on a vehicle, a pair of splitting or bending elements carried by the frame wherein one of the elements is generally convex and one of the elements is fixed to the frame with the other element being mounted on the frame for reciprocating movement along the frame toward and away from the other splitting or bending element. When log splitting is desired, a vertical column is employed in combination with a hydraulic cylinder and a wedge-shaped cutter. Upon actuation of the hydraulic cylinder, the cutter is driven downwardly where a log has been placed on a stationary platform for splitting of the log.

Corey discloses a wood splitter which is particularly suited to hydraulic operation for mechanically splitting sections of wood lengthwise. The device is mounted on a trailer having a flat work deck and a vertical column is employed and coupled to the vertical column is a hydraulic cylinder which acts upon a splitting blade. Once a piece of wood is placed beneath the cutter, the blade is lowered by hydraulic cylinder action by means of a foot lever. Contact of the blade with the wood is sensed by another cylinder which causes a lever arm to raise beneath the wood forcing the wood upwardly and to be split by the blade.

Winiasz discloses a semi-automatic log splitter which includes a set of shearing blades positioned above a log-supporting platform. Beneath the platform is an expanding bellows member which upon air inflation extends upwardly forcing the log into contact with the shearing blades and thereby splitting the logs.

The concepts of a wedge-shaped blade or cutter being vertically driven into contact with the log and the ability for upward vertical movement of the supporting platform are recognized as being old in the art. However, none of the prior art devices discussed herein provide any means for radial adjustment or rotation of the log-supporting base so that the log can be subsequently split at a different location. That particular improvement is detailed herein in accordance with the present invention and provides a novelty and improvement as will be explained. Also included as part of the present invention are unique means for lifting the entire apparatus in conjunction with transportation by a related vehicle.

SUMMARY OF THE INVENTION

An improvement for an adjustable log-splitting apparatus of the type wherein a wedge-shaped cutter is slidably received on a vertical column and the log to be split is placed beneath the cutter according to one embodiment of the present invention comprises a base platform disposed beneath the wedge-shaped cutter and including a top plate member and a supporting frame member, means for connecting the top plate member to the supporting frame member, the connecting means being arranged to permit elevation of the top plate member relative to the support frame member and thereafter to permit manual rotation of the top plate member relative to the supporting frame member, and elevating means for raising the top plate member relative to the supporting frame member.

One object of the present invention is to provide an improved log-splitting apparatus.

Related objects and advantages of the present invention will be apparent from the following description.

DESCRIPTION OF THE PREFERRED EMBODIMENT

Figure 1:
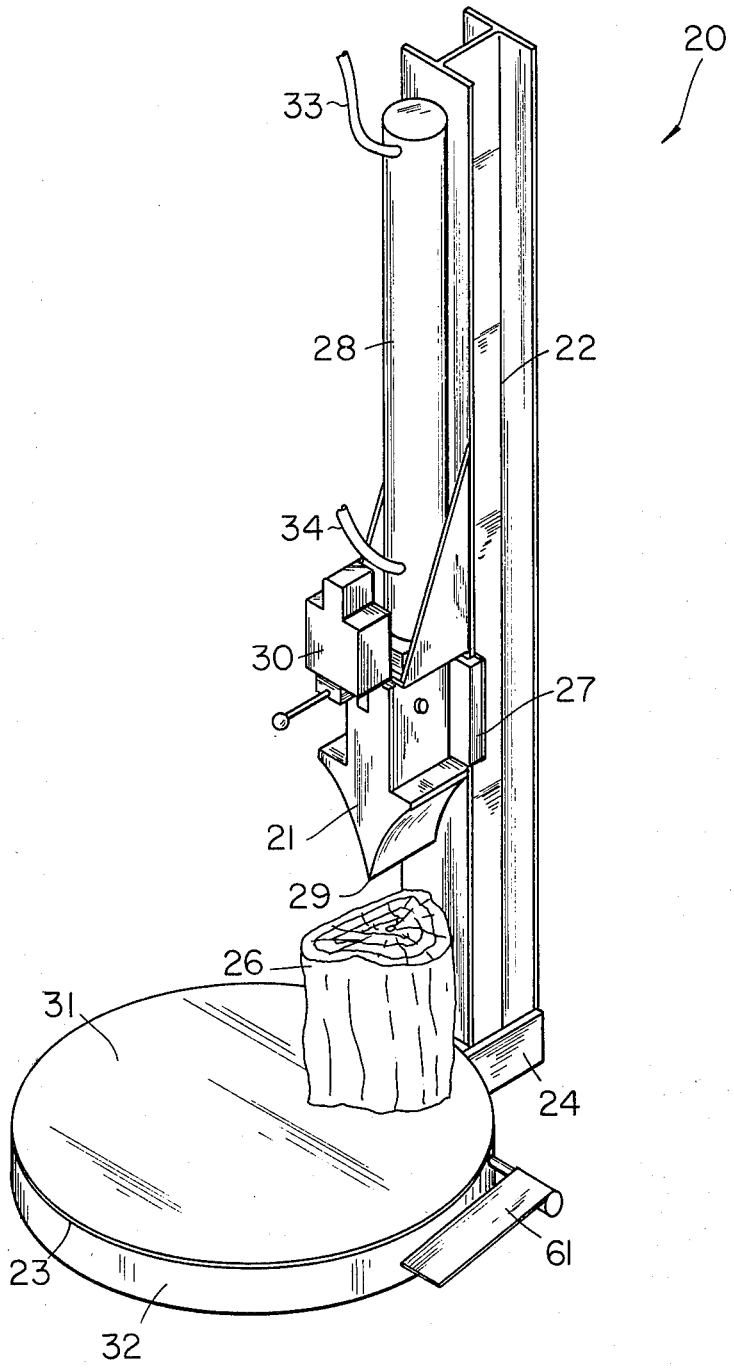
FIG. 1 is a perspective view of an adjustable log-splitting apparatus according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a log-splitting apparatus 20 which includes a wedge-shaped cutter 21, a vertical support column 22 and a base platform 23. The vertical column 22 is rigidly connected to base platform 23 by means of brace 24. The use of conventional mechanical fasteners for the attachment of brace 24 to vertical column 22 and to base platform 23 is acceptable; however, welding these various members together is preferred for strength and rigidity.

Wedge-shaped cutter 21 is secured to vertical column 22 by means of slide 27. In order to effect vertical travel of the wedge-shaped cutter along the vertical column, a power cylinder 28 is disposed above the cutter and is rigidly attached to the vertical column. The piston arm of the power cylinder (which in the exemplary embodiment is a hydraulic cylinder) is rigidly attached to cutter 21. Upon actuation of this power cylinder, its piston arm (not visible in the FIG. 1 illustration) extends in a downwardly direction driving wedge-shaped cutter 21 into log 26. By proper placement of the log onto base platform 23, so that the location for the split is positioned beneath the wedge-shaped cutter, this downward movement of the cutter drives the pointed edge 29 into the splitting location. By proper selection of a suitably sized power cylinder, logs of substantial size, both in diameter and length, are easily split by this apparatus.

Cylinder control 30 governs the energizing and deenergizing of the cylinder for extension and retraction of the piston arm. Hoses 33 and 34 represent connections to a suitable fluid motor and hydraulic pump. Although the vertical position of the power cylinder relative to the vertical column can initially be varied once the height is set, the cylinder is rigidly attached to the vertical column in a fixed position. The wedge-shaped cutter is connected to this power cylinder and by means of slide 27 is freely movable along the vertical column, but the cutter's distance of travel is controlled by the travel of the piston arm.

Although the angular spread or taper of the wedge-shaped cutter may be varied, there is a limit on how much of a particularly sized log may be split. If the diameter size of the log is extremely large, it may not be possible to split the log into two halves. Rather, it may only be possible to split off a smaller fragment from the larger remainder and thereafter split the remainder a second or third time. Multiple splitting may also be desired for quartering the two halves remaining after the first split. At any point in time that a second or subsequent split is desired, it requires that the user of the apparatus reposition the log beneath the cutter so that the subsequent splits can be made. Since such subsequent splits are normally only desired for extremely large logs, the operator of the apparatus must normally exert a fair amount of physical effort in order to reposition the split log fragments. This requirement for additional physical exertion limits the labor savings of prior art apparata for even after devising all of the mechanical advantages to accomplish log splitting, the operator is nevertheless still required to revert to manual labor in order to make the apparatus completely suitable. Clearly, it would be an improvement to this general type of log-splitting apparatus if means were employed to ease the task of repositioning log pieces for additional splits. The present invention provides such an improvement and the particular structure disclosed herein further provides a number of additional advantages as will be apparent from the descriptions which follow.

Figure 3:
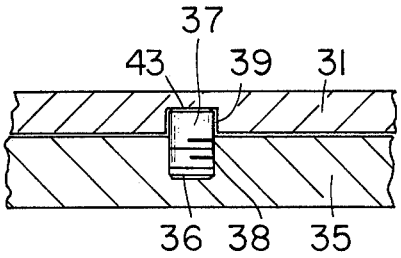
FIG. 3 is a partial, fragmentary, side elevation view of one connection arrangement between the top plate member and the remainder of the base platform.

Base platform 23, if constructed according to conventional designs, would be a single member rigidly attached to the vertical column. However, base platform 23 is in fact a two-part structure including a top plate member 31 and a supporting frame member 32. Referring to FIG. 3, one possible connection between these two members is illustrated. Top plate member 31 is substantially circular and due to its thickness versus diameter ratio, could be considered as a disc or shallow cylinder. The important point is that this member has a circular lateral cross section. Similarly, supporting frame member 32 is a hollow cylindrical structure also having a substantially circular lateral cross section. Extending across supporting frame member 32 from one inside edge to the opposite inside edge is a support brace 35 (see FIG. 2). Centrally disposed within support brace 35 is an internally threaded aperture 36 which is coincident with the geometric center of the cylindrical shape of supporting frame member 32. Top plate member 31 and supporting frame member 32 are connected together by means of a cylindrical post 37 which is externally threaded at one end. This externally threaded end 38 is rigidly received within internally threaded aperture 36. This means of connection securely anchors the cylindrical post to the support brace and thus to the supporting frame member. The opposite end of the cylindrical post is received in a clearance aperture 39 disposed in the underside of top plate member 31.

When a log is in position beneath cutter 21 and the power cylinder is ready for actuation, top plate member 31 should be stationary relative to supporting frame member 32. Although the outer peripheral edge of the top plate member will rest on the outer edge 42 (see FIG. 2) of the supporting frame member, the top edge of the cylindrical post 37 will be at or very near to contact with the base 43 of clearance aperture 39. It is important, however, that the majority, if not all, of the load on top of top plate member 31 be supported by the outer edge 42 of the supporting frame member. Further, it is important that the diameter size of clearance aperture 39 be slightly larger than the outside diameter of cylindrical post 37, although the actual degree of clearance may be only a few thousandths of an inch. The means of connection illustrated in FIG. 3 enables the top plate member to both be raised in a vertical direction to a higher elevation as well as rotated around cylindrical post 37 relative to supporting frame member 32, which remains stationary. The location of aperture 36 is coincident with the geometric center of the cylindrical shape of member 32 and the corresponding geometric center location of clearance aperture 39 insures smooth rotational movement of the top plate member 31 relative to the supporting frame member 32 once a slight degree of vertical separation is created between these two members.

Figure 4:
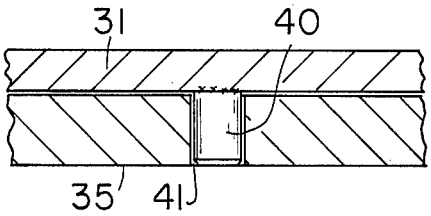
FIG. 4 is a partial, fragmentary, side elevation view of another connection arrangement between the top plate member and the remainder of the base platform.

The movement and dimensional relationships between top plate member 31 and supporting frame member 32 as set forth in FIG. 3 must be preserved, regardless of the exact configuration employed. In fact, due to the limited thickness of the top plate member and the proportionately greater thickness of support brace 35, FIG. 4 represents the preferred connection arrangement for members 31 and 32. Cylindrical stem 40 is welded on the underside to the geometric center of member 31 and extends for almost the full thickness of brace 35 into clearance aperture 41. This arrangement recludes the need for threaded component parts but more importantly allows greater vertical travel without encountering separation of the post or pivot stem from its receiving aperture.

Figure 2:
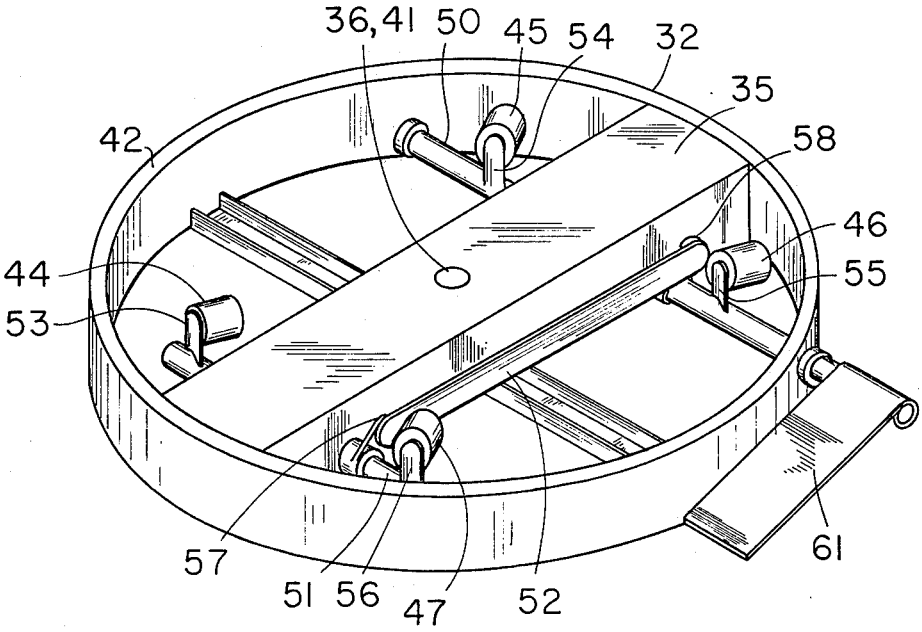
FIG. 2 is a perspective view of a base platform, with its top plate member removed, which comprises a portion of the FIG. 1 apparatus.

The degree of vertical separation between members 31 and 32 is achieved by the roller, linkage and foot treadle arrangement illustrated in FIG. 2. As has been explained previously, supporting frame member 32 is arranged as a hollow, cylindrical shell and extending diametrically from one edge to the other is support brace 35. Also included within the interior clearance region are four rollers 44–47 and each roller is freely rotatable about a corresponding axis line. The four rollers are arranged on two pivot rods 50 and 51 which are substantially parallel to each other and connected together by a pivot link 52. Each roller is attached to its corresponding pivot rod by means of a tab member 53–56, each tab member being welded at its base to its corresponding pivot rod. The opposite ends of these tab members are fitted with a cylindrical pivot stem onto which the various rollers are placed for the described rotational movement. Pivot link 52 is coupled between the two pivot rods by means of links 57 and 58 which are substantially identical to each other and disposed at the same relative angles with respect to their corresponding pivot rods so that a fixed degree of rotation of one pivot rod will be transmitted identically to the other pivot rod.

Rotation of the two pivot rods 50 and 51 is generated by means of foot treadle 61 which is located exterior of supporting frame member 32. By pressing downwardly on the foot treadle 61, such as by the foot of the operator, pivot rod 50 is rotated in a counterclockwise direction (as viewed from the direction of the foot treadle). This counterclockwise rotation is transmitted to pivot rod 51 by means of pivot link 52. The rotation of these two pivot rods also causes the upward movement of the four rollers 44–47. It is to be noted that in the static condition with top plate member 31 resting firmly upon supporting frame member 32, the various axis lines of rotation of the four rollers are each at an inclined (non-horizontal) orientation and do not intersect the axis of rotation (through cylindrical stem 40 or cylindrical post 37) of top plate member 31 relative to supporting frame member 32. However, as the two pivot rods are rotated, these inclined axes of rotation for the various rollers are brought into a substantially horizontal orientation and are moved into alignment with the axis of rotation passing through cylindrical stem 40 (or cylindrical post 37). This rotation of the two pivot rods 50 and 51 also results in raising the various rollers such that their uppermost edges are elevated above the outer periphery edge 42 of member 32. When this occurs, top plate member 31 is elevated above supporting frame member 32 and the top plate member is supported on the various rollers and is free to rotate. This freedom of rotation is permitted because now the axes of rotation of rollers 44–47 are both substantially horizontal (as well as in a common plane with each other) and intersect the axis of rotation of member 31 relative to member 32. Effectively then, these four axes of rotation are radial lines intersecting the geometric center of both the top plate member and the supporting frame member. While some rotational or indexing movement of the top plate member will be generated when the rollers 44–47 are pivoted into position, greater degrees of rotation of the top plate member are effected manually by the operator of the apparatus. However, a significant mechanical advantage is achieved by the use of pivoting rollers and the task in repositioning a log for a second or subsequent split is greatly simplified. Once the log is repositioned, pressure on the foot treadle is relieved and the weight of the log on top plate member 31 causes the two pivot rods and the four rollers to rotate back into the static or "at rest" condition and top plate member 31 is again supported by the supporting frame member 32.

The importance of foot treadle 61 is that it transmits rotational movement to pivot rod 50 for the movement of the four rollers and for raising the top plate member. In certain applications, it may be desirable, or necessary, for the operator to be located somewhere else than beside the foot treadle. Consequently, it is envisioned that the foot treadle be replaced by a power cylinder and associated linkage. By proper linkage coupling of the cylinder piston to the pivot rod, the desired elevation movement of the top plate member can be achieved automatically and from a remote location.

Although the described apparatus is generally intended for multiple splits of a single large log, it is to be noted that the indexing nature of the top plate member lends the apparatus to a faster assembly-line type of log splitting. It is envisioned that additional logs could be placed on the top surface of the top plate member and as each split is made, a new log is rotated into position beneath the cutter. By receiving assistance from a helper, the operator of the apparatus can sequentially split log after log with the helper removing the split pieces and loading on a new single log to be split. This concept, although similar in some regards to a rotating or indexing table in the machine tool art, is believed to be extremely novel for log-splitting apparata and provides a number of advantages in a very reliable, low-cost manner.

Although the construction and operation of log-splitting apparatus 20 incorporates a novel adjustable base platform, one concern with this apparatus as well as with most of the prior art apparata is how to transport the apparatus from location to location. Clearly, if log splitting is being done at a fixed location at all times, then there may not be a need to transport the apparatus to different locations. However, quite often log splitting is done concurrent with the falling and sectioning of trees and thus, log splitting may be at locations within woods or fields or similar areas. When log splitting is desired to be accomplished at these various remote points, it is critical that means be found for transportion of the log-splitting apparatus.

Figure 5:
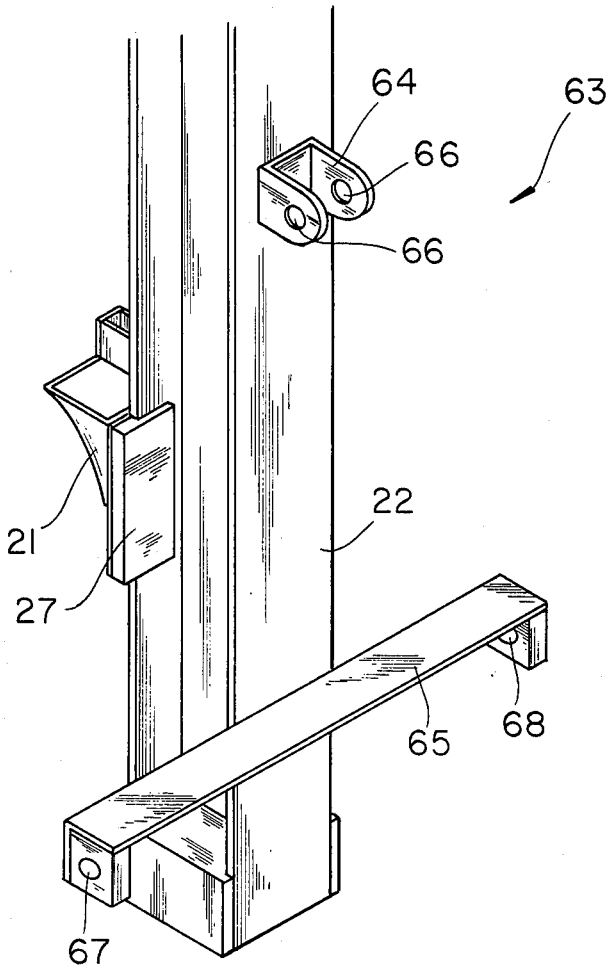
FIG. 5 is a perspective view of lifting means associated with the FIG. 1 log-splitting apparatus.
Figure 6:
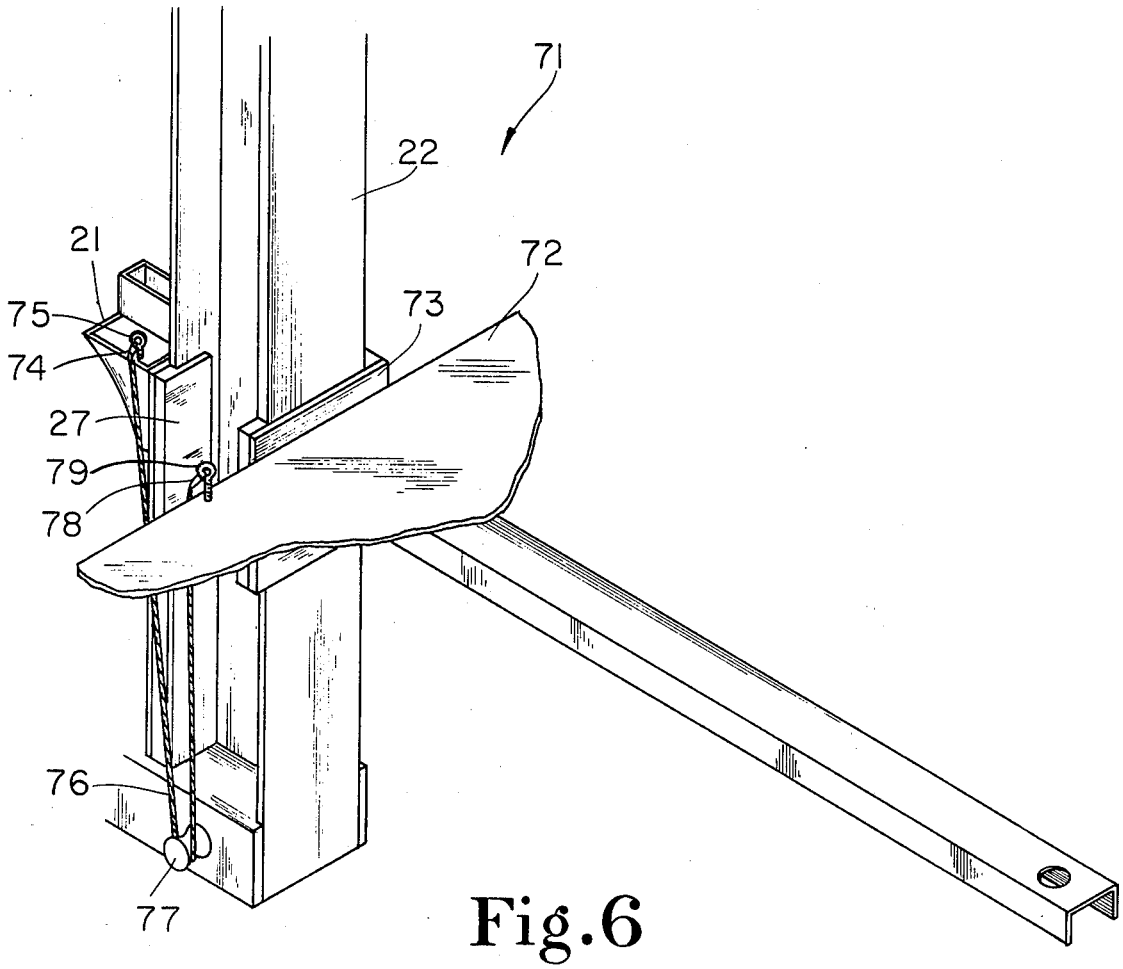
FIG. 6 is a partial perspective view of alternative lifting means associated with the FIG. 1 log-splitting apparatus.

Referring to FIG. 5, lifting means 63 are illustrated as attached to vertical column 22. Lifting means 63 includes a top bracket 64 and a lower bar 65 and these two members combine to create a three-point hitch attachment. The bracket and bar may be attached rigidly to the vertical column by conventional mechanical fasteners, although preferably these two members are rigidly attached by welding. Bracket 64 has a through aperture 66 in each tab and bar 65 has spaced apertures 67 and 68 at opposite ends. These three apertures comprise the three-point hitch connection means for lifting and transportion of apparatus 20.

In certain situations, the vehicle associated with apparatus 20 may not have a three-point hitch connection means, but rather may be part of a trailer or flatbed truck or similar vehicle. In these applications, lifting means 71 is most appropriate. Lifting means 71 actually provides a rigid yet movable connection between the vehicle and the apparatus by support plate 72 and slide 73. Support plate 72 is rigidly attached to the back end of the vehicle, and in the illustrated embodiment is a sturdy flat metal plate which may represent an attachment part to the vehicle or the flatbed of a truck or similar structural surface. Slide 73 is fitted to the back edge of vertical column 22 very similar to the manner in which slide 27 is fitted to the front edge of the vertical column. In this application, a vertical column in the shape of an I-beam is most suitable. Slide 73 is rigidly attached to flat plate 72 so that there is no relative motion between these two parts. Lifting of apparatus 20 by means of lifting means 71 is achieved in the following manner. First, the power cylinder 28 which couples to and acts in both directions on cutter 21 is energized so as to place the cutter in its lowest-most position. When in this position, hook 74 is attached to eyebolt 75 and the corresponding cable 76 (wire rope) is wrapped around pulley 77. The opposite end of cable 76 is also fitted with a hook 78 which attaches to eyebolt 79. Eyebolt 75 is rigidly secured to the top edge of cutter 21 and eyebolt 79 is rigidly attached to plate 72. Upon energizing of cylinder 28 in order to vertically raise cutter 21, a force is exerted through cable 76 and creates a downward pulling force on plate 72. This downward pulling force causes vertical column 22 to move relative to plate 72 and slide 73 thereby lifting apparatus 20. Once the apparatus is lifted off of the ground level, the vehicle with which plate 72 is associated can then transport the apparatus to a new log-splitting location. Flat plate 72 provides a convenient mounting location for the fluid motor and pump which are associated with the cylinder 28. In the FIG. 5 arrangement, the three-point hitch lifting means would normally be associated with a tractor and the tractor hydraulics can be used as replacements for the otherwise separate motor and pump requirements.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An adjustable log-splitting apparatus of the type wherein a wedge-shaped cutter is slidably recieved on a vertical column, a log to be split is placed beneath the wedge-shaped cutter and drive means move the cutter into contact with the log, wherein the improvement comprises:

a base platform disposed beneath the wedge-shaped cutter and including a top plate member and a supporting frame member;

means for connecting said top plate member to said supporting frame member, said connecting means being arranged to permit elevation of said top plate member relative to said supporting frame member and thereafter to permit manual rotation of said top plate member relative to said supporting frame member; and elevating means for raising said top plate member relative to said supporting frame member.

2. The improvement of claim 1 wherein said connecting means includes a cylindrical post rigidly attached to said top plate member and both slidably and pivotally received by said supporting frame member.

3. The improvement of claim 1 wherein said elevating means includes a foot treadle and a plurality of rollers connected to said foot treadle, said plurality of rollers being located within said supporting frame member and arranged for movement into direct contact with the underneath side of said top plate member.

4. The improvement of claim 3 wherein said elevating means further includes two pivot rods, each having two rollers attached thereto and a connecting link coupling said two pivot rods together, said foot treadle being connected to one of said two pivot rods for rotation of said rods.

5. The improvement of claim 4 wherein said connecting means includes a cylindrical post rigidly attached to said top plate frame member and both slidably and pivotally received by said supporting frame member.

6. The improvement of claim 4 wherein the four rollers are movable between a stationary position and an elevated position by means of said foot treadle, each roller having an axis of rotation which intersects the axis of rotation of said top plate member when said rollers are in said elevated position.

7. The improvement of claim 2 wherein said elevating means includes a foot treadle and a plurality of rollers connected to said foot treadle, said plurality of rollers being rotated within said surrounding frame member and arranged for movement into direct contact with the underneath side of said top plate member.

8. The improvement of claim 1 wherein said elevating means includes a plurality of rollers disposed beneath said top plate member and movable between a raised position and retracted position, said top plate member being manually rotatable by means of said plurality of rollers when said plurality of rollers are in said raised position.

9. The improvement of claim 1 wherein said top plate member and said surrounding frame member are each substantially circular in lateral cross-sectional shape and said connecting means includes a post centrally located relative to said top plate member and to said surrounding frame member, said post being rigidly attached to said top plate member and pivotally received in said supporting frame member.

10. The improvement of claim 1 wherein said elevating means includes a foot treadle operatively coupled to said top plate member for movement of said top plate member to a raised position.

11. A portable log-splitting apparatus arranged for transportation by an associated vehicle comprising:

a support column;

a wedge-shaped cutter slidably received on said support column;

a power cylinder rigidly attached to said support column and cooperatively arranged relative to said wedge-shaped cutter for movement of said wedge-shaped cutter;

a base platform disposed beneath said wedge-shaped cutter, said base platform including a log-supporting top plate which is movable toward said wedge-shaped cutter and rotatable about a central pivot axis; and lifting means for raising said log-splitting apparatus up from its supporting surface for transportation.

12. The portable log-splitting apparatus of claim 11 wherein said lifting means includes a three-point hitch attachment welded to said support column.

13. The portable log-splitting apparatus of claim 11 wherein said lifting means includes a plate rigidly attached to said associated vehicle and slidably received on said support column and a cable connected between said cutter and said plate and wrapped around an intermediate pulley whereby upward movement of said cutter raises said apparatus relative to said associated vehicle.

* * * * *